United States Patent [19]

Kathmann et al.

[11] 4,123,203

[45] Oct. 31, 1978

[54] MULTISTAGE HELICAL SCREW COMPRESSOR WITH LIQUID INJECTION

[75] Inventors: Stephen J. Kathmann; Roger L. Post; Michael G. Herschler; Sylvester L. Anerino, all of Quincy, Ill.

[73] Assignee: Gardner-Denver Company, Dallas, Tex.

[21] Appl. No.: 842,426

[22] Filed: Oct. 14, 1977

[51] Int. Cl.[2] ..... F04B 39/02; F04C 23/00; F04C 29/08; F04C 29/02

[52] U.S. Cl. ..... 417/252; 418/9; 418/14; 418/84; 418/99

[58] Field of Search ..... 418/99, 9, 14, 97, 98, 418/10; 417/252, 251

[56] References Cited

U.S. PATENT DOCUMENTS

| | | | |
|---|---|---|---|
| 1,422,376 | 7/1922 | Richards | 417/252 |
| 2,957,419 | 10/1960 | Michel | 417/252 |
| 3,168,236 | 2/1965 | Lamberton | 418/14 X |
| 3,349,994 | 10/1967 | Bloom | 417/252 X |
| 3,431,856 | 3/1969 | Whitmore et al. | 417/252 X |
| 3,941,505 | 3/1976 | Nasvytis et al. | 417/252 X |

*Primary Examiner*—C. J. Husar
*Assistant Examiner*—Leonard E. Smith
*Attorney, Agent, or Firm*—Michael E. Martin

[57] ABSTRACT

In a two-stage liquid injected helical screw gas compressor a bypass line with a check valve is provided between compressor stages for delivering compressed gas from the first stage directly to the compressed gas receiver and liquid reservoir. Bypass of gas to the reservoir at startup assures pressurization of the reservoir and early flow of liquid to the first and second stage compression chambers. As the working pressure in the second stage discharge line increases above first stage discharge pressure, the check valve closes and all flow from the first stage is conducted through the second stage compression chamber.

8 Claims, 5 Drawing Figures

MULTISTAGE HELICAL SCREW COMPRESSOR WITH LIQUID INJECTION

BACKGROUND OF THE INVENTION

Liquid injected helical screw compressors are characterized by a liquid circulation system wherein a liquid such as mineral oil is continuously injected into the compression chamber for cooling, sealing and lubrication functions. The liquid is discharged with the gas being compressed by the compressor, is separated from the compressed gas, cooled, and recirculated back into the compression chamber. Circulation of the liquid may be provided by the differential pressure between the liquid reservoir and the compression chamber at the point of injection of liquid or a pump driven by a power takeoff shaft may be provided to circulate the liquid. Liquid flow into the compressor must occur early and at adequate rates during compressor startup to prevent overheating and failure of the compressor rotor bearings and other working parts requiring lubrication and cooling. Multistage compressors are particularly difficult to start without overheating due to the fact that compression starts immediately in the first stage but liquid reservoir pressure does not increase fast enough to assure adequate liquid circulation due to the throttling effect or flow resistance caused by the second or subsequent compressor stages. This condition is further aggravated in a compressor wherein the first stage compression ratio is greater than the second stage compression ratio since a relatively rapid and greater temperature rise occurs in the first stage compression chamber and relatively greater bearing loadings are experienced.

SUMMARY OF THE INVENTION

The present invention is characterized by a multistage helical screw compressor with a liquid injection system wherein early circulation of liquid into the compressor stages is provided during startup to minimize overheating due to compression and to provide adequate lubrication of the rotor bearings and gearing.

In accordance with the present invention a multistage helical screw gas compressor is provided with a bypass conduit which is in communication with the combination liquid reservoir-gas receiver tank and with the first stage discharge passage. Gas compressed by the first stage is conducted directly to the reservoir during compressor startup to cause a pressure increase sufficient to initiate liquid circulation into the compressor to provide adequate cooling and lubrication. A check valve in the bypass conduit closes when the pressure in the second stage discharge conduit or the reservoir exceeds the interstage pressure whereupon substantially all fluid discharged from the first compression stage then flows through the second compression stage.

Further, in accordance with the present invention there is provided a liquid flow circuit and control system for a helical screw gas compressor wherein a sufficient flow of liquid is provided to the compressor during starting and idling conditions as well as when the compressor is operating at maximum working discharge pressures.

DESCRIPTION OF THE PREFERRED EMBODIMENT

Figure 1:
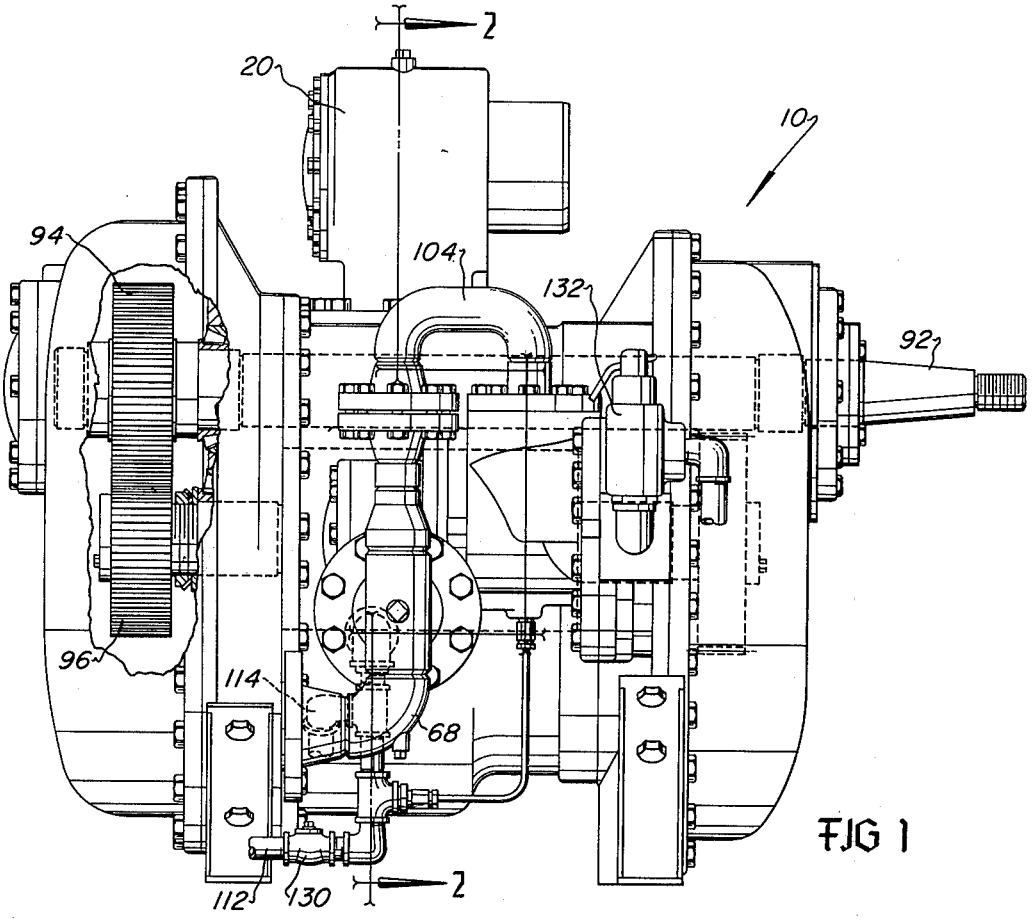
FIG. 1 is a longitudinal side elevation of a helical screw compressor in accordance with the present invention.
Figure 2:
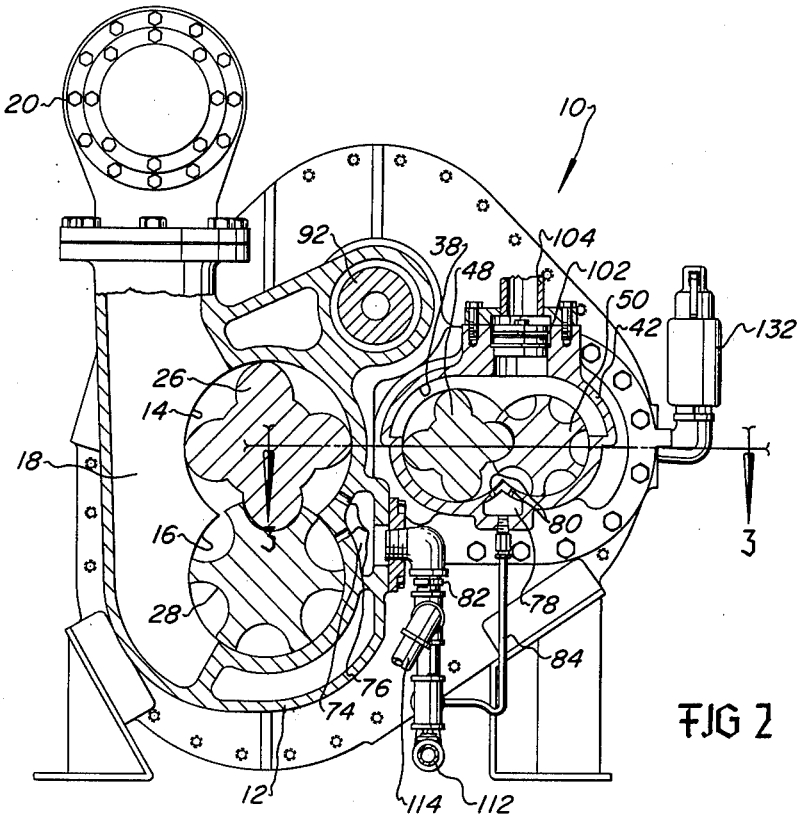
FIG. 2 is a section view taken along the line 2—2 of FIG. 1.
Figure 3:
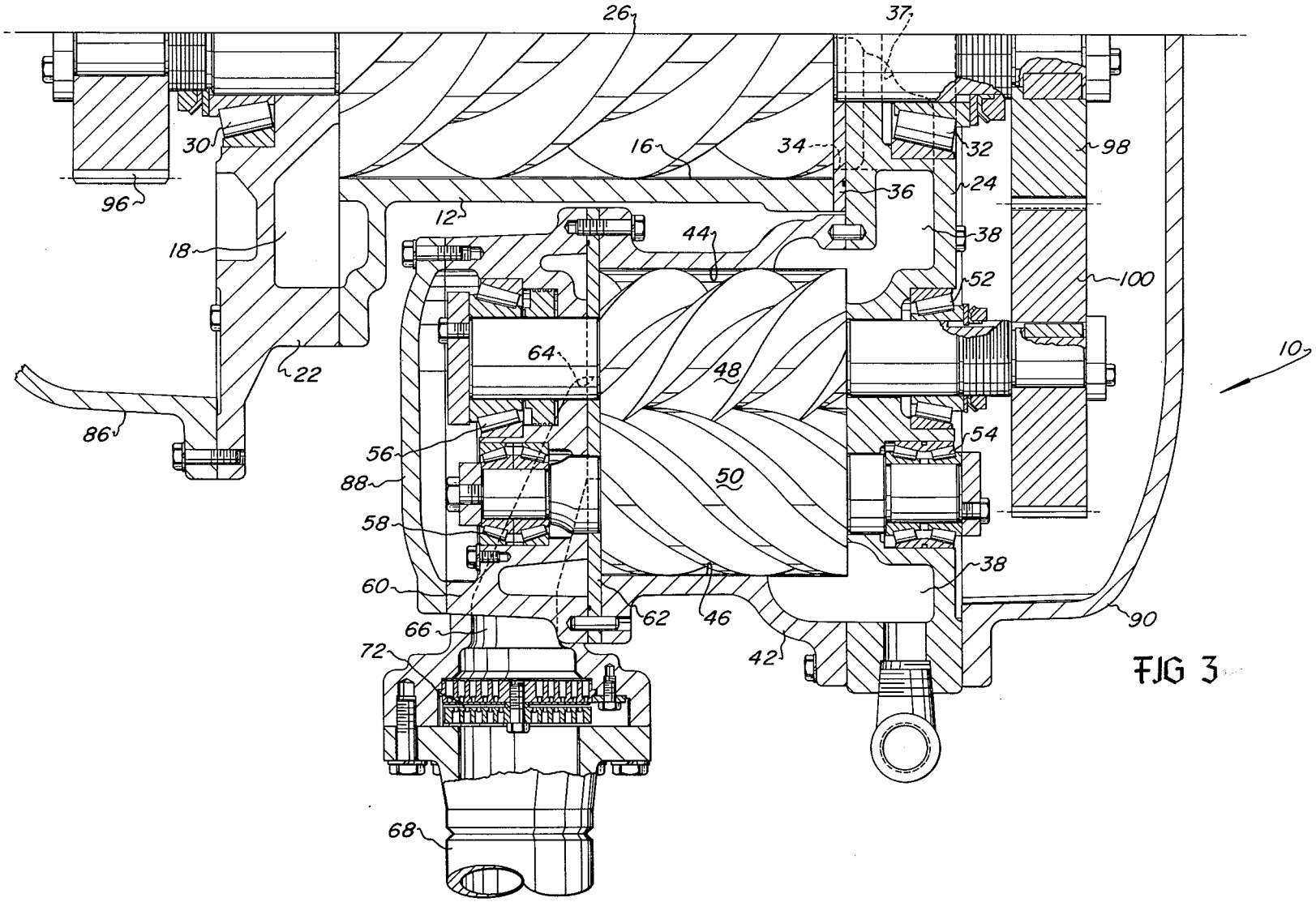
FIG. 3 is a section view taken along the line 3—3 of FIG. 2.

Referring to FIGS. 1, 2 and 3 of the drawings the present invention is characterized by a multistage liquid injected compressor, generally designated by the numeral 10. The compressor 10 is adapted to compress ambient air as the working gas. However, those skilled in the art will appreciate that the compressor 10 may be adapted to operate with other gases also. The compressor 10 includes a low pressure casing 12 which, as shown in FIG. 2, is characterized by parallel intersecting bores 14 and 16. An inlet port 18 is formed in the casing 12 and communicates with the bores 14 and 16 and with an inlet throttling valve 20. The valve 20 is of a well known type and is similar to the compressor inlet throttling valve disclosed in U.S. Pat. No. 3,260,444 to R. F. Williams et al. The compressor 10 is further characterized by respective inlet and discharge casing end portions 22 and 24. Intermeshing helical screw rotors 26 and 28 are disposed in the respective bores 14 and 16 and are rotatably supported in bearings 30 and 32 as shown by way of example for the rotor 14 in FIG. 3. The rotors 26 and 28 cooperate with each other and with the casing in a known way to form variable volume chevron-shaped chambers which compress air admitted through the valve 20 and inlet porting 18. The air compressed by the rotors 26 and 28 is discharged through a port 34 formed in a platelike member 36 disposed across one end of the bores 14 and 16 and interposed between the casing portions 12 and 24 as shown in FIG. 3.

Figure 4:
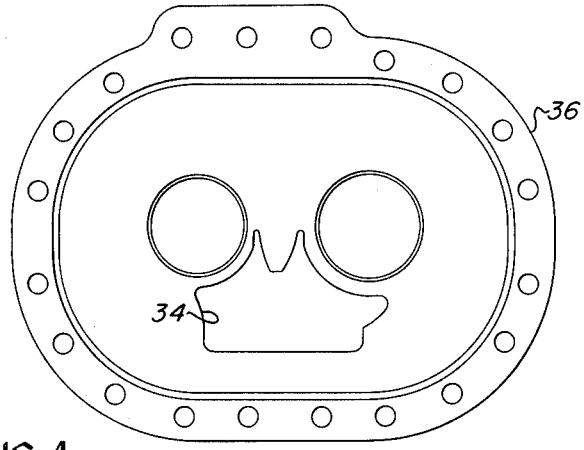
FIG. 4 is a plan view of a discharge end plate insert used on the compressor of FIGS. 1 through 3; and, FIG. 5 is a schematic diagram of the liquid injection system and control circuit for the compressor of the present invention.

The discharge end plate 36 is also shown in FIG. 4. The size of the port 34 may be changed by providing interchangeable plates with different port sizes and configurations whereby the built-in volume ratio of the low pressure compressor stage may be varied as desired. The built-in volume ratio is defined as the ratio of the volume of one of the aforementioned chevron-shaped chambers formed by the intermeshing rotors at the condition when the chamber moves out of communication with the inlet port to the volume of said chamber when it moves into communication with the discharge port.

The compressor 10 is further characterized by passage means 37 formed in the casing portion 24 which is in communication with the discharge port 34 and with an inlet port 38 for a second compression stage of the compressor 10. The second compression stage is characterized by a casing 42 which is suitably fastened to and supported by the casing portion 24. The second stage casing 42 also includes a pair of parallel intersecting bores 44 and 46 in which are disposed respective intermeshing helical screw rotors 48 and 50. The rotors 48 and 50 are rotatably mounted on suitable roller bearings 52 and 54 disposed in the casing portion 24 and bearings 56 and 58 disposed in a discharge end casing member 60. The casing member 60 is suitably fastened to the second stage casing 42. A discharge plate 62, similar to the plate 36, is interposed between the member 60 and the casing 42 and includes a discharge port 64 which opens into passage means 66.

Figure 5:
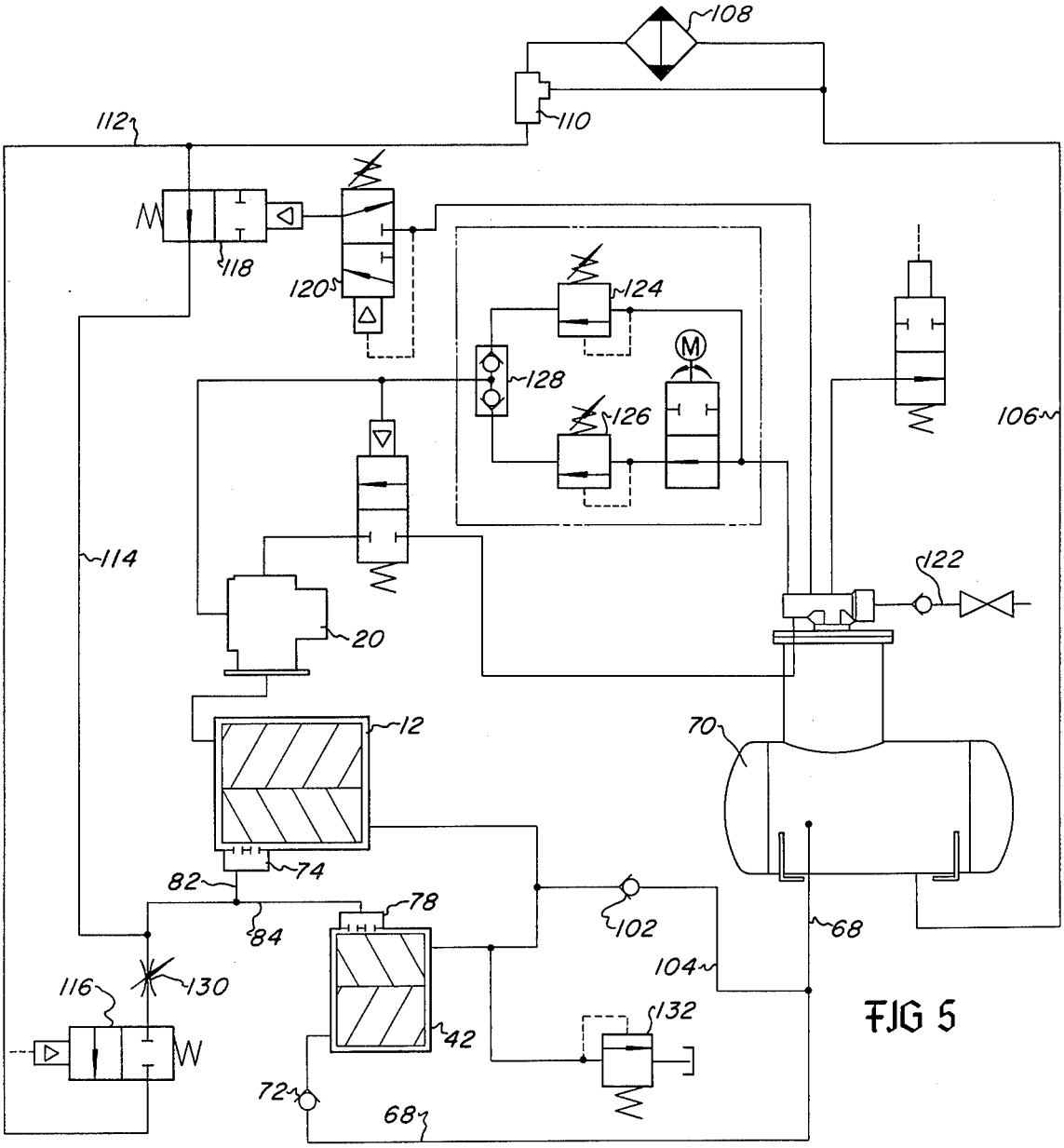

The passage means 66 is in communication with a conduit 68 leading to a combined gas receiver and liquid reservoir tank 70 as shown in the schematic diagram of FIG. 5. A check valve 72 of the multiple ring or plate type is interposed in the passage means 66, FIG. 3, to prevent backflow of fluid from the discharge conduit 68 into the compression chambers formed by the rotors 48 and 50 and the bores in the casing 42. A valve similar to the valve 72 is disclosed in detail in U.S. Pat. No. 3,260,444 with reference to FIG. 4 of the drawings of the patent.

Referring to FIG. 2, the casing 12 is provided with a chamber or gallery 74 and passage 76 which open from the gallery into the cylinder bores 14 and 16. The casing 42 is provided with a similar gallery 78 and passages 80 which open into the bores 44 and 46. Suitable conduits 82 and 84 are in communication with the galleries 74 and 78 for conducting liquid thereto to be injected into the cylinder bores of each of the casings 12 and 42. Further passages, not shown, also open into the galleries 74 and 78 and lead to the bearings and gearing of the compressor for cooling and lubrication of those elements. Liquid is collected in sumps formed in each of the cavities formed by the casing members and respective cover members 86, 88 and 90 and is conducted to a passage, not shown, opening into one of the bores 14 or 16 in the vicinity of the inlet port 18 whereby during operation of the compressor liquid is constantly circulated by the pressure differential between the aforementioned sumps and the inlet port. U.S. Pat. No. 3,178,104 to R. F. Williams et al. disclosed a liquid circulation system for helical screw compressors which system may be adapted to the compressor 10.

Referring to FIGS. 1 through 3, the compressor 10 further includes a drive shaft 92 which may be connected to a suitable prime mover. The shaft 92 is drivably connected to the rotor 26 by respective intermeshing drive gears 94 and 96 mounted on the shaft and the rotor. The opposite end of the rotor 26 includes a drive gear 98 which is meshed with a gear 100 mounted on the rotor 48. The respective rotor sets of the first and second compression stages of the compressor 10 are not provided with synchronizing gears since the rotor pairs are designed to provide for the rotors 28 and 50 to be driven by the fluid pressures acting thereon and by the respective rotors 26 and 48.

Referring to FIG. 2 in particular, the casing 42 includes a recess in which is disposed a check valve 102 similar to the check valve 72. The check valve 102 is interposed between the inlet port 38 to the second compression stage and a bypass conduit 104 which is connected to the discharge conduit 68 as shown in FIG. 1. The check valve 102 is arranged to permit fluid flow from the inlet port 38 to the bypass conduit 104 but to prevent flow in the reverse direction. Accordingly, whenever the fluid pressure in the inlet port 38 is greater than the fluid pressure in the discharge conduit 68 the valve 102 will open to bypass working fluid which has been discharged from the low pressure compression stage directly to the discharge conduit and the reservoir tank 70.

Referring to FIG. 5, the compressor 10 includes a liquid recirculation system comprising the reservoir tank 70, conduit means 106 leading to a liquid cooler 108 and a temperature control valve 110, a conduit 112 leading from the temperature control valve to the galleries 74 and 78 in the compressor and an alternate conduit 114 also leading to the galleries in the compressor. A two-position normally closed valve 116 is interposed in the conduit 112 and a two-position normally open valve 118 is interposed in the conduit 114 as shown in FIG. 5. The valve 118 is operable to be actuated to be closed by a control signal from a pilot control valve 120 in response to fluid pressure in the reservoir tank 70 increasing above a predetermined minimum pressure. The valve 116 is normally operated to open in response to starting the compressor, for example upon receiving a signal responsive to starting the compressor prime mover or engaging suitable power transmission means connected to the drive shaft 92.

The reservoir tank 70 may be provided with means for separating liquid from the air compressed by the compressor whereby substantially liquid-free air may be conducted to its end use by way of a conduit 122. The tank 70 may for example be constructed to be similar to the combined separator-reservoir tank disclosed in U.S. Pat. No. 3,917,474 to F. W. Heckenkamp et al.

The schematic diagram of FIG. 5 also shows a control valve arrangement for operating the inlet throttling valve 20 to shut off the inlet flow of air into the low pressure compression stage in response to the pressure in the tank 70 reaching a predetermined maximum. The pressure at which the inlet throttling valve 20 is operated to close is determined by which of the pressure responsive valves 124 or 126 is operable to provide a pressure signal by way of a shuttle valve 128 to the throttling valve 20.

As previously mentioned the circulation of liquid through the compressor 10 is due to the pressure difference between the pressure in the reservoir tank 70 and the location of the injection passages 76 and 80 in the respective compression chambers of the first and second compression stages. Upon starting of the compressor the inlet throttling valve is open and air is admitted to the first or low pressure compression stage. As the compressor rotors accelerte to operating speed the discharge flow from the first compression stage tends to be throttled by the second compression stage due to its lower swept volume capacity as compared to the first stage. This lower swept volume or swallowing capacity of the second compression stage is further aggravated in compressors wherein the first stage has a greater built-in volume ratio and hence a greater built-in pressure ratio than the second stage. Accordingly, on startup the pressure in the discharge port 34 and inlet port 38 increases rapidly but the inability of the second stage to accept the discharge flow of the first stage prevents reservoir tank pressure from increasing fast enough to provide adequate circulation of liquid to the galleries 74 and 78. Such a condition might result in rapid overheating and seizure or scoring of the rotors in both compression stages as well as damage to the rotor bearings and drive gears. However, thanks to the present invention the check valve 102 responds to the slightest pressure increase in the second stage inlet port 38 to open to bypass first stage discharge flow directly to the tank 70 by way of the conduits 104 and 68 whereby a rapid pressure increase in the tank is assured and which is sufficient to initiate and sustain adequate liquid circulation to cool and lubricate the compressor.

In a relatively short time the pressure in the tank 70 will increase to a value greater than the pressure in the inlet port 38 due to the work of compression of the second stage whereupon the check valve 102 will close and all flow discharged from the first compression stage will be directed through the second stage so that compression to the final operating pressure may be accomplished efficiently.

The liquid circulation system for the compressor 10 further assures adequate liquid flow to the compressor when the working pressure is decreased for any reason below a predetermined minimum. The liquid circulation system for the compressor 10 includes flow control means designated by the orifice 130 shown in FIG. 5. The orifice 130, which may be adjustable, is provided to prevent excess liquid flow to the compressor for the normal working pressure in the tank 70 when the liquid is at normal working temperature also. However, on startup and when the liquid is at less than normal working temperature the orifice 130 may restrict liquid flow too much to provide adequate cooling and lubrication. Accordingly, the alternate conduit 114 as shown in FIG. 5 bypasses the orifice 130 and is operable to conduct liquid to the galleries 74 and 78 when the valve 118 is open. The valve 118 is controlled to be open anytime the pressure in the tank 70 is less than a predetermined minimum. For example, if the orifice 130 is sized for optimum liquid flow to the compressor when the working pressure in the tank 70 is approximately 2000 kPa then the valve 120 may be set to actuate the valve 118 to be open at any pressure less than approximately 1400 kPa to assure adequate liquid flow at low working pressures.

Referring again to FIGS. 1 and 3, the compressor 10 is further provided with an emergency pressure relief valve 132 which is in communication with the second stage inlet port 38. The valve 132 may be one of several known types which are responsive to a predetermined pressure condition to open when the pressure increases beyond said predetermined pressure. In the event of a failure of the check valve 102 to prevent the backflow of the compressed air-liquid mixture from the discharge conduit 68 to the inlet port 38 the pressure relief valve 132 will open to discharge fluid into a conduit 134 leading away from the immediate vicinity of the compressor. Opening of the relief valve 132 will minimize recirculation of fluid through the second stage in the event of a failure of the check valve 102 and, accordingly, the tendency for the second stage to overheat due to recirculation of the compressed air-liquid mixture is minimized. Moreover, the relief valve 130 will minimize overpressurization of the casing portion 24 when the compressor is shut down without depressurizing the tank 70.

What is claimed is:

1. A multistage helical screw gas compressor comprising:

a first casing defining a pair of parallel intersecting bores in which are disposed a pair of intermeshing helical screw rotors forming a first compression stage;

a first inlet port and a first discharge port opening into said first casing;

a second casing defining a pair of parallel intersecting bores in which are disposed a pair of intermeshing helical screw rotors forming a second compression stage;

a second inlet port and a second discharge port opening into said second casing;

passage means connecting said first discharge port with said second inlet port;

a compressed gas receiver and liquid reservoir tank;

conduit means connecting said second discharge port with said tank;

means for circulating liquid from said tank to said first and second compression stages for cooling and mixing with the gas being compressed by said first and second compression stages;

a bypass conduit interconnecting said second inlet port with said tank for conducting gas compressed by said first compression stage to said tank without passing through said second compression stage; and, a check valve interposed in said bypass conduit and responsive to a pressure differential between said second inlet port and said tank for causing compressed gas discharged from said first compression stage to be conducted directly to said tank to thereby force liquid stored in said tank to be circulated to said first and second compression stages on starting said compressor.

2. The invention set forth in claim 1 wherein:

said means for circulating liquid comprises conduit means interconnecting said tank with liquid injection passage means in said respective first and second casings, said liquid injection passage means opening into compression chambers formed in said bores in said casings, said passage means opening into a zone of each of said compression chambers which is normally at a working pressure less than the fluid pressure in said tank.

3. The invention set forth in claim 2 wherein:

said conduit means includes a first conduit in communication with said tank and said liquid injection passage means;

a flow restricting orifice interposed in said first conduit; and, a liquid bypass conduit interconnecting said tank and said liquid injection passage means.

4. The invention set forth in claim 3 together with:

a valve interposed in said liquid bypass conduit and operable to be in an open condition in response to the fluid pressure in said tank being less than a predetermined minimum.

5. The invention set forth in claim 1 wherein:

said compressor includes a bearing support member having said passage means and at least a portion of said second inlet port formed therein, said bearing support member also comprising a common support for bearings supporting one end portion of said pairs of rotors of said first and second compression stages.

6. The invention set forth in claim 5 together with:

a first removable plate interposed between said first casing and said bearing support member and forming a transverse end wall of said first compression stage, said plate including said first discharge port formed therein.

7. The invention set forth in claim 6 together with:

a second removable plate forming a transverse end wall of said second compression stage, said second plate including said second discharge port formed therein and being interposed between said second casing and a bearing support for bearings supporting the ends of said pair of rotors of said second compression stage opposite the said one end portion.

8. The invention set forth in claim 1 wherein:

said compressor includes a pressure relief valve in communication with said second inlet port for limiting the maximum fluid pressure in said second inlet port.

* * * * *